US008256188B2

(12) United States Patent
Blumenstock et al.

(10) Patent No.: US 8,256,188 B2
(45) Date of Patent: Sep. 4, 2012

(54) PACKAGING MACHINE

(75) Inventors: Klaus Blumenstock, Satteldorf (DE); Christian Koehler, Altenburg (DE); Jochen Ziegler, Satteldorf (DE)

(73) Assignee: Robert Bosch GmbH, Stuttgart (DE)

( * ) Notice: Subject to any disclaimer, the term of this patent is extended or adjusted under 35 U.S.C. 154(b) by 261 days.

(21) Appl. No.: 12/594,116

(22) PCT Filed: Feb. 25, 2008

(86) PCT No.: PCT/EP2008/052223

§ 371 (c)(1), (2), (4) Date: Sep. 30, 2009

(87) PCT Pub. No.: WO2008/122463

PCT Pub. Date: Oct. 16, 2008

(65) Prior Publication Data

US 2010/0058711 A1 Mar. 11, 2010

(30) Foreign Application Priority Data

Apr. 4, 2007 (DE) ..... 10 2007 016 249

(51) Int. Cl.
*B67B 3/10* (2006.01)

(52) U.S. Cl. ..... 53/331; 53/286

(58) Field of Classification Search ..... 53/286, 53/289, 329, 331, 333, 334
See application file for complete search history.

(56) References Cited

U.S. PATENT DOCUMENTS

| | | | | | |
|---|---|---|---|---|---|
| 3,537,231 | A * | 11/1970 | Dimond | 53/201 |
| 3,701,016 | A * | 10/1972 | Bennett et al. | 455/90.3 |
| 3,775,944 | A * | 12/1973 | Roberts | 53/334 |
| 3,878,667 | A * | 4/1975 | Holstein | 53/340 |
| 4,099,361 | A * | 7/1978 | Dix et al. | 53/488 |
| 4,221,105 | A * | 9/1980 | Guest | 53/488 |
| 4,466,548 | A * | 8/1984 | Herbert | 215/307 |
| 4,600,347 | A | 7/1986 | Segredo et al. | |
| 5,125,215 | A * | 6/1992 | Orsinger et al. | 53/492 |
| 5,400,564 | A | 3/1995 | Humphries et al. | |
| 5,809,742 | A * | 9/1998 | Takakusaki et al. | 53/317 |
| 6,105,343 | A | 8/2000 | Grove et al. | |
| 6,367,301 | B1 * | 4/2002 | Bassani | 72/94 |
| 6,679,026 | B1 * | 1/2004 | Cirio | 53/317 |
| 2005/0204710 | A1 * | 9/2005 | Denom et al. | 53/490 |
| 2005/0257623 | A1 * | 11/2005 | Kitamoto et al. | 73/761 |
| 2006/0145881 | A1 | 7/2006 | Sakatani et al. | |

FOREIGN PATENT DOCUMENTS

| | | | |
|---|---|---|---|
| DE | 10324925 | A1 | 12/2004 |
| EP | 0618168 | A1 | 10/1994 |
| EP | 1213066 | A1 | 6/2002 |
| WO | 9315957 | A1 | 8/1993 |
| WO | 9422614 | A1 | 10/1994 |

* cited by examiner

*Primary Examiner* — Paul R Durand
(74) *Attorney, Agent, or Firm* — Michael Best & Friedrich LLP

(57) ABSTRACT

The invention relates to a packaging machine for closing a container having a lid, which includes a supply unit for delivering the container along with a loosely seated lid. A rotating crimping head is provided with a plurality of recesses for one container each, a plurality of tensioning units each hold a container into a recess, and a crimping unit crimps the lids onto the container in order to close the container. A plurality of sensor units are provided such that one sensor unit is arranged on each tensioning unit. Each sensor unit records a container rotation and/or a container tensioning force in the crimping head. Each sensor unit has a transmitter to send signals and a control unit which has a receiver to receive signals sent from the transmitter.

16 Claims, 4 Drawing Sheets

PACKAGING MACHINE

CROSS-REFERENCE TO RELATED APPLICATION

This application is a 35 USC 371 application of PCT/EP2008/052223 filed on Feb. 25, 2008.

BACKGROUND OF THE INVENTION

1. Field of the Invention

The invention relates to a packaging machine, in particular a crimping machine, which crimps a cover onto a container in order to close the container.

2. Description of the Prior Art

A variety of packaging machine embodiments are known from the prior art. For example, in order to close small drug-filled vials, a cover is crimped onto the upper rim of each vial. In this case, the vial must be closed securely. It is therefore necessary to assure a high degree of process reliability during the closing procedure. Experience has shown that a secure closing of the vials is successfully achieved if the vial executes approximately 5 to 6 rotations during the crimping procedure. Particularly when a clamping force of the vial is not sufficiently powerful, the vial may rotate fewer than the required number of times. Consequently, in order to assure that the vials have been correctly closed, the packaging machine is followed by a quality control, which checks the closing quality of the vials.

ADVANTAGES AND SUMMARY OF THE INVENTION

The packaging machine according to the invention for closing containers with a cover has the advantage over the prior art that it is possible to monitor the closing procedure inside the machine. According to the invention, it is consequently possible to assure an increase in the process reliability of the closing procedure and to eliminate a subsequent quality control. The results of the monitoring of the closing procedure can be wirelessly transmitted to a control unit. This is achieved according to the invention in that the packaging machine includes a rotating crimping head and a supply unit for supplying the containers with loosely placed covers. The crimping head has a plurality of receptacles, each for holding one container, a plurality of clamping devices that clamp the container into the receptacle, and a crimping device that crimps the cover onto the container in order to close it. The packaging machine according to the invention also has a plurality of sensor devices that are situated on the crimping head in order to record a rotation of a container in the crimping head and/or a clamping force of the container in the crimping head. In this case, a sensor device is associated with each respective clamping device. Furthermore, each sensor device includes a sensor that transmits the recorded signals to a control unit that is equipped with a correspondingly embodied receiver. Consequently, according to the invention, it is possible to detect and monitor the number of rotations of the container and/or a clamping force of the container during the crimping procedure. The wireless transmission of signals makes it possible for the sensor devices to be situated directly on the rotating crimping head. It is thus possible to eliminate complex wiring and the like.

According to another preferred embodiment, each sensor device has a sensor system for evaluating the recorded sensor signals. This makes it possible for a signal processing to take place directly in the sensor device so that only the results have to be wirelessly transmitted to the control unit. This makes it possible in particular to minimize the energy consumption for the transmission of signals since instead of entire signal sequences, only a result is transmitted.

According to a particularly preferred embodiment, the transmitter and the sensor system are integrated into a single component. For example, this can be embodied in the form of a printed circuit board with an integrated antenna. This makes it possible in particular to reduce the required amount of space for the sensor system and the transmitter.

According to another preferred embodiment, the sensor system determines a maximum value of the clamping force, provided that the sensor device has a sensor for determining the clamping force, and transmits only this maximum value of the clamping force to the control unit. Preferably, a minimum value of the clamping force can also be transmitted to the control unit.

In order to assure an energy supply for the sensor device, the packaging machine also preferably includes a stator and each sensor device has an energy storage device in order to assure an inductive energy supply. The inductive energy supply has the particular advantage of being a maintenance-free energy supply for the sensor devices. Alternatively or in addition, each sensor device can also include a battery for supplying energy. The use of batteries, however, is disadvantageous to the extent that these must be replaced after a certain period time, which can lead to undesirable stoppages of the packaging machine.

According to another preferred embodiment of the invention, the sensor device includes a Hall sensor for detecting a rotation of the container during the closing procedure. The use of a Hall sensor for detecting the number of rotations has the particular advantage of being very rugged and compact.

According to another preferred embodiment, a sensor of the sensor device is embodied as a strain gauge or a load cell in order to record a clamping force. In particular, using strain gauges results in a very compact, operationally reliable sensor.

Preferably, the clamping device includes a plunger mechanism, which is for clamping a container and exerts a clamping force on the container via the cover that is set loosely onto the container.

According to a particularly preferable embodiment, a transmitter of the sensor device is situated at an upper end of the plunger mechanism. In another preferred embodiment, in order to protect the transmitter in the plunger mechanism, a stop can also be provided that limits a travel of a plunger.

The packaging machine according to the invention is in particular used for closing small vials with a cover or sealing cap. The packaging machine here is particularly suited for applications in the pharmaceutical sector since it is possible to document a secure closing, for example through storage of the recorded values during the closing procedure.

BRIEF DESCRIPTION OF THE DRAWINGS

A preferred exemplary embodiment of the invention is described in detail below with reference to the accompanying drawings.

DESCRIPTION OF THE PREFERRED EMBODIMENT

The packaging machine 1 according to a preferred exemplary embodiment of the invention will be described in detail below with reference to FIGS. 1 through 4.

Figure 1:
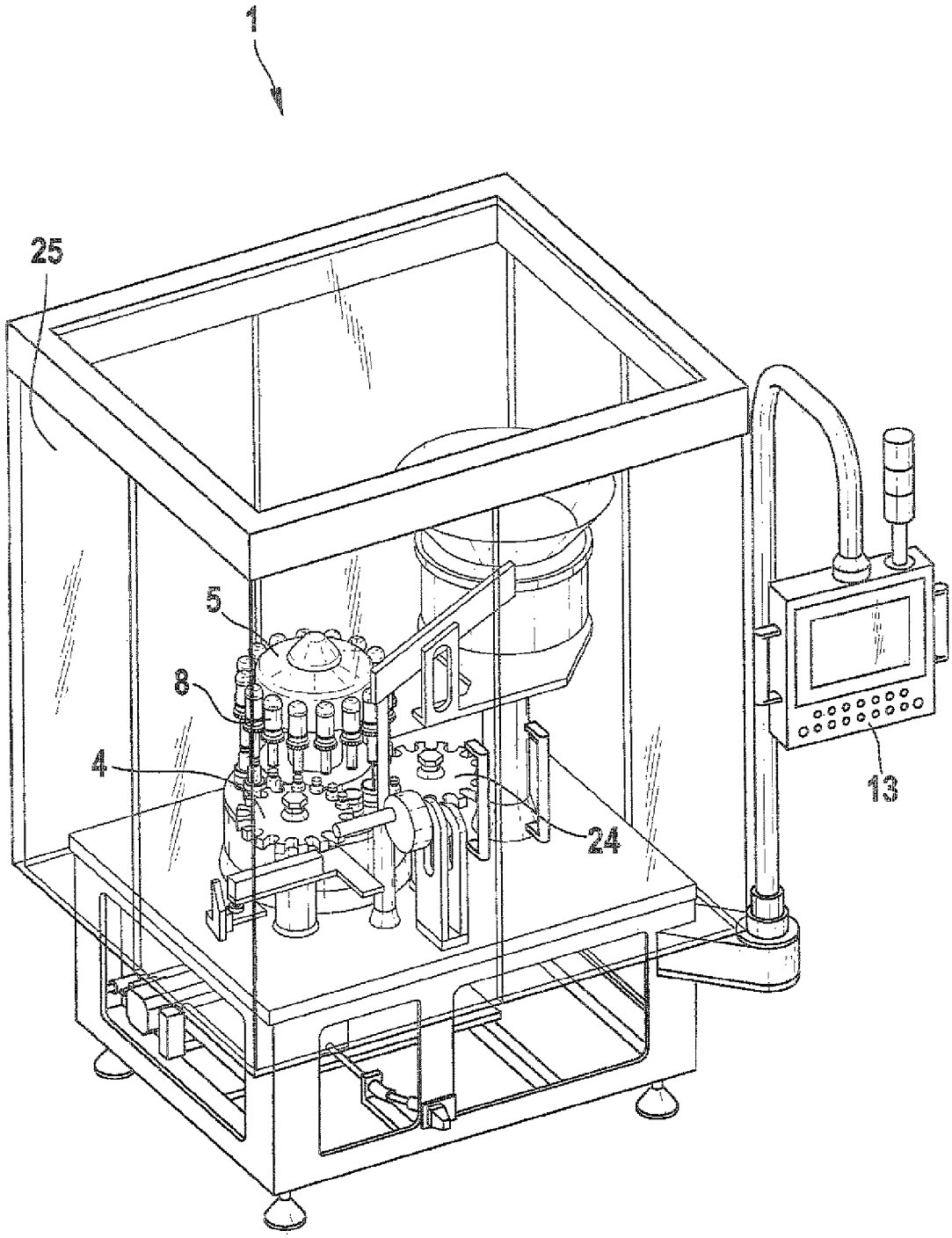
FIG. 1 is a perspective view of a packaging machine 1 according to a first exemplary embodiment of the invention.
Figure 2:
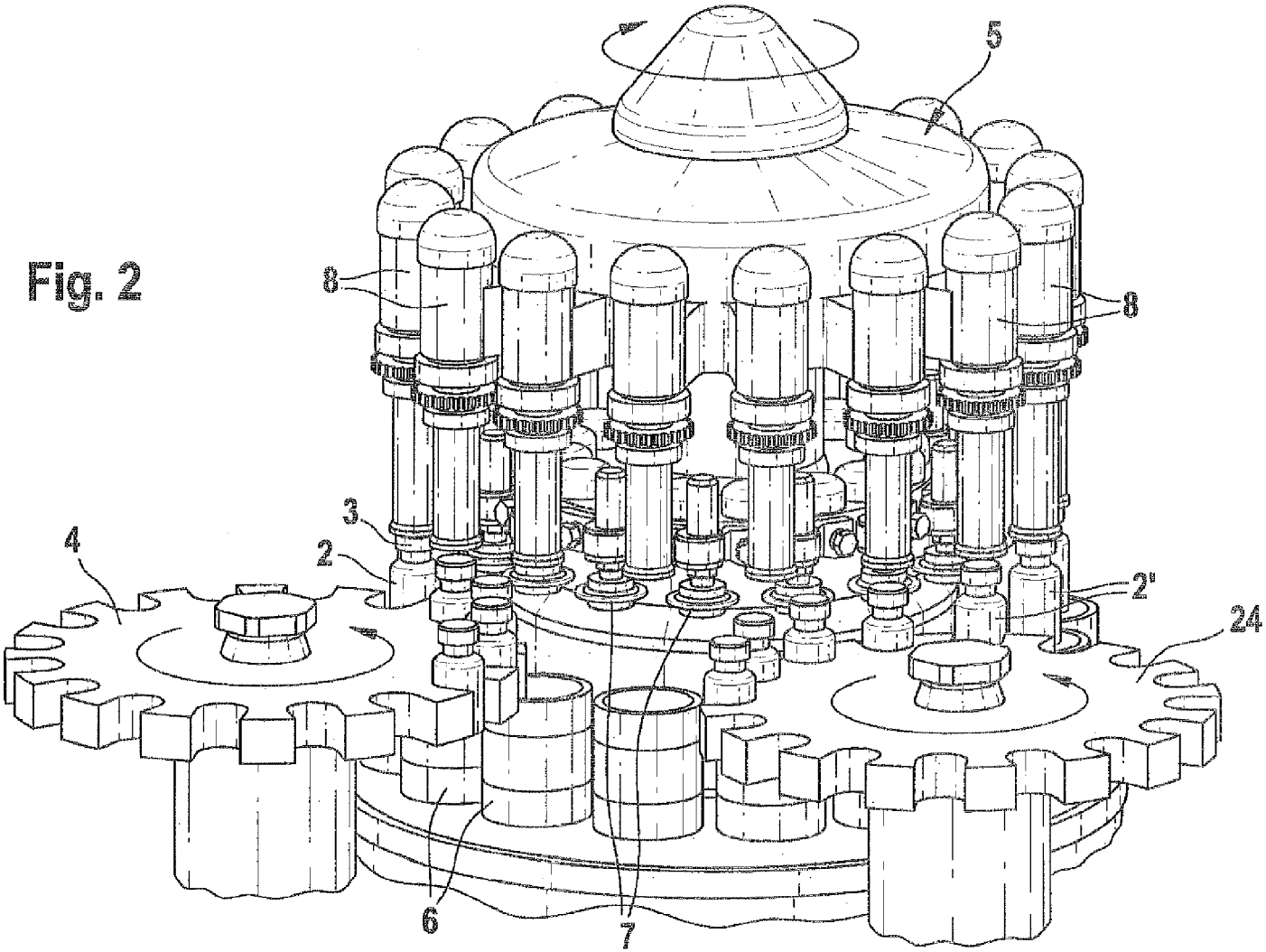
FIG. 2 is an enlarged perspective view of a crimping head of the packaging machine shown in FIG. 1.

FIG. 1 is an overall view of the packaging machine 1. The packaging machine 1 in this exemplary embodiment is a crimping machine that crimps a cover 3 onto a container 2 (FIG. 2). Machines of this kind are particularly used to close drug containers in the form of vials or cannulas. FIG. 1 schematically depicts essential components of the packaging machine 1, which particularly include a crimping head 5 and supply units for filled vials and covers. In order to protect against contamination of the powder or liquids dispensed into the container 2, the packaging machine 1 is situated inside a glass housing 25. As is particularly visible in FIG. 2, the packaging machine 1 also includes a supply unit 4 in the form of a gear-like element and a similarly embodied removal unit 24. The supply unit 4 supplies containers 2—onto each of which a respective cover 3, cap, or the like is loosely placed—to the crimping head 5. In FIG. 2, the containers onto which a cover 3 has been crimped so that the container is securely closed are labeled with the reference numeral 2'. The closed containers 2' are removed from the crimping head by the removal unit 24.

As is also visible in FIG. 2, the crimping head 5 includes a plurality of cylindrical receptacles 6 into which the containers 2 with the loosely placed covers 3 are supplied by means of the supply unit 4. At the bottom of each of the receptacles 6, a respective plate, not shown, is provided, onto which the containers 2 are placed; the plate can be rotated around its own axis by means of a drive mechanism that is not shown. In addition the crimping head 5 includes a plurality of crimping devices 7, which are embodied in the form of rolling wheels in this exemplary embodiment. As the containers 2 travel over a predetermined arc range of approx. 120° around the crimping head 5, the loosely placed covers 3 are brought into contact with the crimping devices 7 in order to crimp the cover 3 firmly onto the container 2. The crimping head 5 also has a plurality of clamping devices 8, which are embodied in the form of plunger mechanisms in this exemplary embodiment. As is clear from FIG. 2, each receptacle 6 is associated with its own respective clamping device 8 and its own respective crimping device 7. The clamping device 8 serves to press the container 2 firmly against the bottom plate in the receptacle 6, making it possible to assure that the container 2, together with the cover 3 loosely placed onto it, rotates around its own axis in order to allow the crimping devices 7 to crimp the cover 3 onto the container 2. The containers 2' with the crimped-on covers are then removed from the crimping head 5 by the removal unit 24 and are then supplied, for example, to a carton packaging station.

Figure 4:
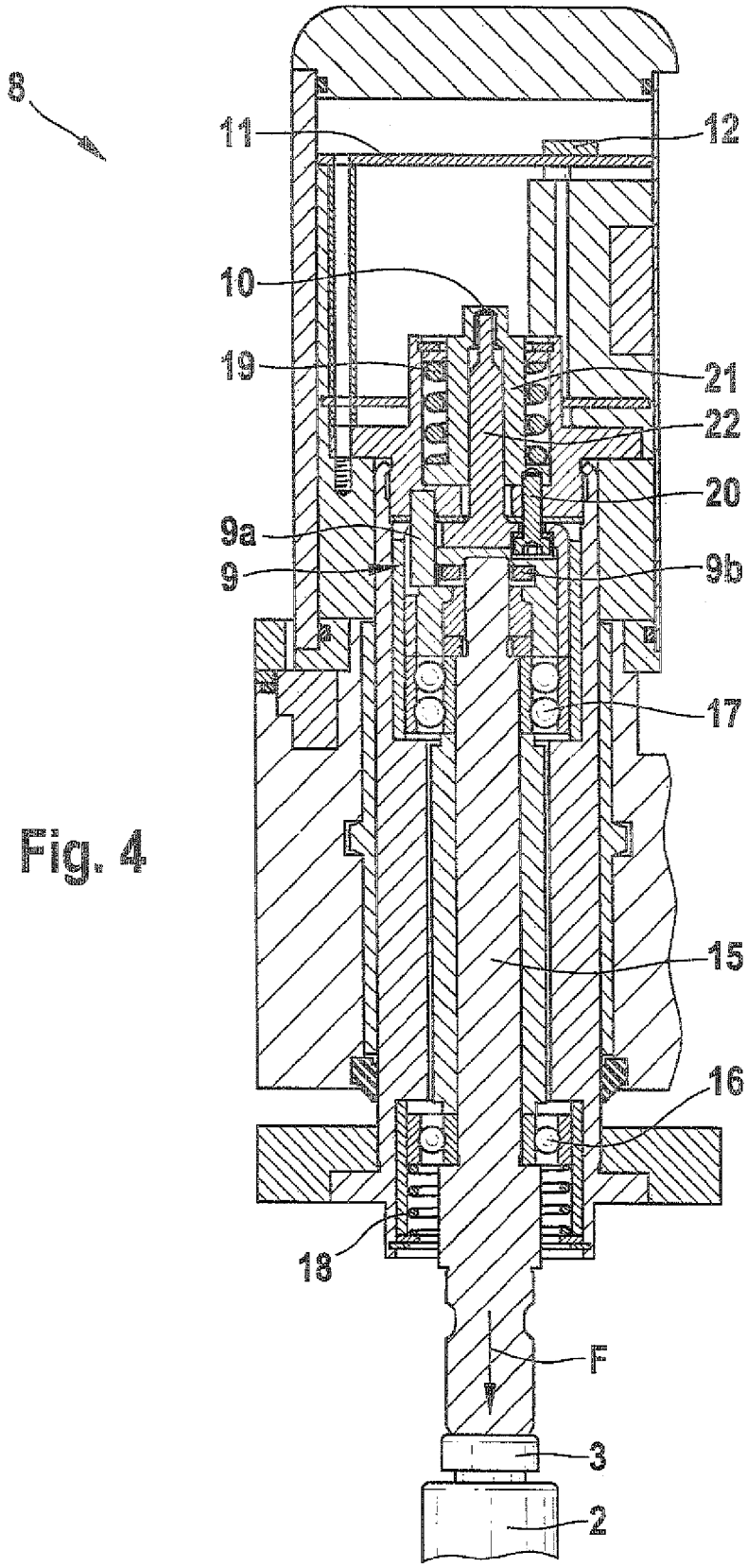
FIG. 4 is a schematic sectional view of a plunger mechanism of the crimping head according to the exemplary embodiment.

FIG. 4 is a more precise depiction of one of the clamping devices 8, all of which are embodied the same. The clamping devices 8 in this exemplary embodiment are embodied in the form of plunger mechanisms and each have a respective plunger 15, which is supported in rotating fashion by means of two bearings 16 and 17. As indicated by the arrow F in FIG. 4, the plunger 15 can exert a clamping force on the loosely placed covers 3, thus pressing the container 2 against the rotating plate at the bottom of the receptacles 6. To this end, the plunger mechanism is pressed against the cover 3 by means of a stroke curve, not shown, which produces a clamping pressure in accordance with the course of the curve at different positions in the circumference direction. Consequently, one end of each clamping device 8, together with the crimping head 5 and the respective plunger 15, continues to rotate around its center axis. The plunger mechanism 5 also includes a compression spring 18, which pre-stresses the plunger mechanism, a slider 22, which is situated in a collar sleeve 21, a rotation-preventing device 20 to prevent a rotation of the nonrotating components of the plunger mechanism, and a spring 19 that functions as an overload preventing device whose purpose is to prevent the production of an excessive clamping force F.

As is also visible particularly in FIG. 4, the packaging machine 1 according to the invention also includes a sensor device, which on the one hand, monitors the clamping force F of the containers in the crimping head 5 and on the other hand, monitors the rotating movement of the containers 2 to be closed. To this end, the sensor device according to the invention includes a first sensor 9 with a Hall sensor element **9*a* and a plurality of transducer elements 9*b*. As is visible in FIG. 4, the transducer elements 9*b* are attached to the plunger 15 that rotates around its own axis. The Hall sensor element 9*a* is mounted in stationary fashion. The Hall sensor element 9*a* is connected to a printed circuit board 11, permitting a processing of the recorded signals of the Hall sensor element. The printed circuit board 11 includes a transmitter 12 for a wireless transmission of signals to a control unit 13 (see FIG. 1). The sensor device also includes a second sensor 10, which detects a clamping force of the containers 2 in the crimping head 5. The second sensor 10 in this exemplary embodiment is embodied in the form of a strain gauge and is likewise connected to the printed circuit board 11. The second sensor is situated at the upper end of the collar sleeve 21. The printed circuit board 11 also performs the evaluation of the signals of the second sensor 10. It should be noted that the second sensor 10** can, for example, also be embodied in the form of a load cell or another sensor for detecting force.

Figure 3:
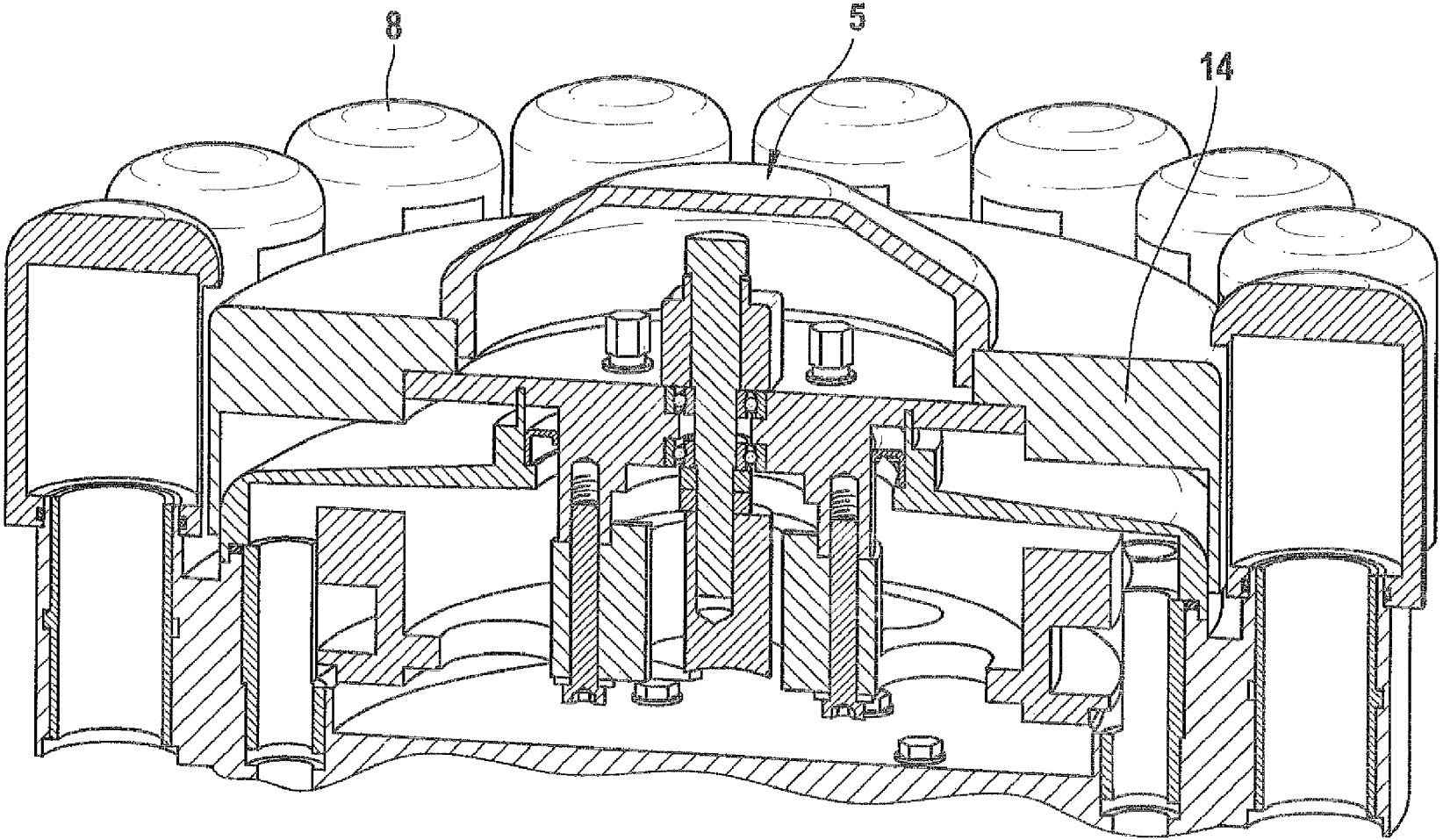
FIG. 3 is a schematic sectional view of part of the crimping head shown in FIG. 2.

Consequently, according to the invention, the first sensor 9 can detect a number of rotations of the container in the crimping head 5 and the second sensor 10 can detect a clamping force of the container in the crimping head 5. In this case, the signals of the first and second sensors are evaluated in the printed circuit board 11. The evaluated data thus generated are then wirelessly transmitted via the transmitter 12 to the control unit 13. In order for each of the printed circuit boards 11 in the respective clamping devices 8 to be supplied with energy, each printed circuit board includes an energy receiving device and an energy storage device. As shown in FIG. 3, the crimping head 5 contains an annular stator 14, thus permitting the required energy for the printed circuit board 11 to be transmitted inductively. The stator 14 can also perform the task of defining the beginning and end of a measurement. The inductive energy transmission to the printed circuit board 11 makes it possible to produce a particularly maintenance-free packaging machine since no stoppages are required for changing a battery, which could, for example, also act as the energy supply for the printed circuit board 11. It should be noted that it is also possible for redundancy reasons to additionally provide each printed circuit board 11 with a battery in order to assure the energy supply for the printed circuit board 11 for example in the event of temporary transmission problems from the stator.

In order to minimize the energy consumption of the printed circuit boards 11 and in particular of the transmitter 12 as much as possible, preferably a distance between the transmitter 12 and the control unit 13 is very small, e.g. between 0.5 m and 1 m. In this case, it is also possible to situate a receiver as close as possible to the crimping head 5 in the packaging machine 1 and then to provide a cable connection to the control unit 13. This makes it possible to significantly reduce the necessary energy demand of the printed circuit boards 11.

Furthermore, it should be noted that it is naturally also possible for the printed circuit board 11 to perform no evaluation of the signals of the sensors 9, 10, but only to transmit the recorded measurement data directly to the control unit 13 in which the evaluation of the measurement data is then carried out.

According to the invention, the packaging machine 1 is thus able to carry out a monitoring of a closing procedure of containers 2 with respective covers 3. In this connection, it is possible to detect a separate measurement result with regard to a clamping force and a number of rotations in the crimping head for each container 2. A signal transmission to a control unit 13 then occurs wirelessly, e.g. by means of radio. It is thus possible to omit wiring which can only be implemented in a very complex fashion, in particular due to the rotation of the crimping head 5. According to the invention, it is thus possible to increase a process reliability of the closing procedure and in addition, to store the recorded measurement data of the closing procedure separately for each container, e.g. for documentation purposes. This can be important particularly in pharmaceutical applications.

The foregoing relates to the preferred exemplary embodiment of the invention, it being understood that other variants and embodiments thereof are possible within the spirit and scope of the invention, the latter being defined by the appended claims.

The invention claimed is:

1. A packaging machine for closing a container having a cover, comprising:

a supply unit for supplying the container with a loosely placed cover;

a rotating crimping head having a plurality of receptacles, each for receiving a respective container, and a plurality of clamping devices, each for holding a respective container in a respective receptacle, each clamping device having a crimping device, which crimps the cover onto the container in order to close the container, each clamping device comprising a housing;

a plurality of sensor devices, with each sensor device mounted within said housing of each said clamping device, with each sensor device detecting a rotation of a container and/or a clamping force on said respective container in the crimping head, and with each sensor device including a transmitter for transmitting signals to a receiver;

a control unit, which includes said receiver for receiving the signals transmitted by the transmitter; and a stator and an energy storage device, the energy storage device being connected to at least the transmitter, wherein it is possible to charge the energy storage device in a contactless fashion via the stator.

2. The packaging machine as recited in claim 1, wherein each sensor device includes a sensor system which performs an evaluation of recorded values of the sensor device, after which the transmitter transmits results of the evaluation to the receiver.

3. The packaging machine as recited in claim 2, wherein the transmitter and the sensor system are integrated into one component, in particular a printed circuit board.

4. The packaging machine as recited in claim 3, wherein the sensor system determines at least a maximum value of the clamping force and transmits the maximum value of the clamping force to the control unit.

5. The packaging machine as recited in claim 4, wherein each transmitter is connected to a battery functioning as an energy supply.

6. The packaging machine as recited in claim 4, wherein the sensor device includes a Hall sensor for recording a rotation of the container in the crimping head during the closing procedure.

7. The packaging machine as recited in claim 2, wherein the sensor system determines at least a maximum value of the clamping force and transmits the maximum value of the clamping force to the control unit.

8. The packaging machine as recited in claim 7, wherein each transmitter is connected to a battery functioning as an energy supply.

9. The packaging machine as recited in claim 2, wherein the clamping device includes a plunger mechanism.

10. The packaging machine as recited in claim 9, wherein a transmitter and/or a sensor system is situated at an upper end of the plunger mechanism.

11. The packaging machine as recited in claim 1, wherein each transmitter is connected to a battery functioning as an energy supply.

12. The packaging machine as recited in claim 3, wherein each transmitter is connected to a battery functioning as an energy supply.

13. The packaging machine as recited in claim 1, wherein the sensor device includes a Hall sensor for recording a rotation of the container in the crimping head during the closing procedure.

14. The packaging machine as recited in claim 1, wherein the sensor device includes a strain gauge or a load cell for recording the clamping force in the crimping head.

15. The packaging machine as recited in claim 1, wherein the clamping device includes a plunger mechanism.

16. The packaging machine as recited in claim 15, wherein a transmitter and/or a sensor system is situated at an upper end of the plunger mechanism.

* * * * *